US005787651A

United States Patent [19]

Horn et al.

[11] Patent Number: 5,787,651

[45] Date of Patent: Aug. 4, 1998

[54] SOUND DEADENING WALL ASSEMBLY

[75] Inventors: Michael E. Horn, Rochester; Joseph D. Heffelmire, Noblesville, both of Ind.

[73] Assignee: Modern Materials, Inc., Rochester, Ind.

[21] Appl. No.: 688,984

[22] Filed: Jul. 31, 1996

Related U.S. Application Data

[60] Provisional application No. 60/016,751 May 2, 1996.

[51] Int. Cl.[6] ..... E04B 1/82

[52] U.S. Cl. ..... 52/144; 52/481.1; 52/730.6

[58] Field of Search ..... 52/479, 481.1, 52/481.2, 236.7, 236.9, 238.1, 239, 241, 144, 145, 347, 393, 404.1, 730.6, 731.5, 731.7, 731.8, 731.9, 483.1, 265, 267; 428/598, 603

[56] References Cited

U.S. PATENT DOCUMENTS

| | | | |
|---|---|---|---|
| 3,270,472 | 9/1966 | Gilbert | 52/481.1 X |
| 3,304,609 | 2/1967 | Young | 52/481.1 X |
| 3,305,993 | 2/1967 | Nelsson | 52/481.1 |
| 3,324,615 | 6/1967 | Zinn . | |
| 3,611,653 | 10/1971 | Zinn . | |
| 3,885,362 | 5/1975 | Pollock . | |
| 3,911,636 | 10/1975 | Larsson . | |
| 3,950,912 | 4/1976 | Lundberg et al. . | |
| 3,972,167 | 8/1976 | Vogeli . | |
| 4,018,020 | 4/1977 | Sauer et al. . | |
| 4,041,667 | 8/1977 | Lindner et al. . | |
| 4,079,553 | 3/1978 | Kirk, Jr. . | |
| 4,130,972 | 12/1978 | Varlonga . | |
| 4,361,994 | 12/1982 | Carver . | |
| 4,376,361 | 3/1983 | Michael . | |
| 5,067,294 | 11/1991 | McGowan . | |
| 5,140,792 | 8/1992 | Daw et al. . | |
| 5,517,795 | 5/1996 | Doke | 52/731.5 X |
| 5,553,437 | 9/1996 | Navon | 52/730.6 X |

FOREIGN PATENT DOCUMENTS

| | | | |
|---|---|---|---|
| 3202359 | 12/1982 | Germany | 52/481.1 |
| 2164966 | 4/1986 | United Kingdom | 52/731.7 |

OTHER PUBLICATIONS

Lord, Attenborough, Guy, Maekawa, *Transforming Wall Studs to Slit Resonator Studs for Improving Sound Insulation in Walls*, applied acoustics, Elsevier Applied Science, vol. 43, No. 1, 1994.

Loney, *Effect of Cavity Absorption on the Sound Transmission Loss of Steel–Stud Gypsum Wallboard Partitions*, The Journal of Acoustical Society of America, Sep. 15, 1969.

Loney, *Effect of cavity absorption and multiple layers of wallboard on the sound–transmission loss of steel–stud partitions*, Acoustical TechnologySection, National Gypsum Research Center, Nov. 23, 1973.

*Sound transmission loss of gypsum wallboard partitions. Report #1. Unfilled steel stud partitions*, J. Acoust. Soc. Am. 71(1), Jan. 1982.

Green, Sherry, *Sound transmission loss of gypsum wallboard partitions. Report #2. Steel stud paritions having cavities filled with glass fiber batts*, J. Acoust. Soc. Am. 71(4), Apr.1982.

*Primary Examiner*—Creighton Smith

*Attorney, Agent, or Firm*—Barnes & Thornburg

[57] ABSTRACT

A sound deadening wall assembly comprising a first wall panel attached to a first stud member, a second wall panel situated parallel to the first wall panel and attached to a second stud member, wherein the stud members abut each other with a resilient attachment material therebetween to secure the first and second stud members to each other. The stud members are of C-shape cross-section with the open end of the C-shape facing in opposite directions and abutting each other to create an overall S-shape when the stud members are joined together. Separable end and top members are also disclosed.

19 Claims, 4 Drawing Sheets

SOUND DEADENING WALL ASSEMBLY

This application is a continuation of Provisional application Ser. No. 60/016,751 filed May 2, 1996.

BACKGROUND AND SUMMARY OF THE INVENTION

The present invention relates to building materials for building walls and particularly to a sound deadening wall assembly for minimizing the transmission of sound through the wall assembly. More particularly, the present invention relates to a steel framed wall assembly including metal studs, the steel frame dampening the transmission of sound through the wall assembly. The invention also relates to sound deadening structural members such as studs.

Conventional steel framed walls are typically fabricated by placing a metal floor channel along a floor, placing a metal ceiling channel along a ceiling above the metal floor channel, connecting ends of the floor and ceiling channels with vertical side wall channels attached to side walls abutted by the conventional steel framed wall, and connecting the floor and ceiling channels with spaced apart metal studs, each stud consisting essentially of a vertical metal channel. First and second drywall panels are then typically fastened to each respective side of the conventional floor channels, ceiling channels, side wall channels, and studs. The opposing drywall panels, which comprise the outer opposing surfaces of the two sides of the conventional wall, are thus directly connected to each other by the floor channel, the ceiling channel, the side wall channels, and by the stud channels. Additional drywall panels are sometimes attached to the first and second drywall panels of the conventional wall to provide wall panels of double or triple thickness in an attempt to reduce sound transmission.

It is known to provide wall systems that deaden the sound transmission between the wall and the ceiling. For example, U.S. Pat. No. 4,018,020 to Sauer et al. discloses a wall including a ceiling track or head channel member fastened to the ceiling and provided with a strip of resilient cushioning material interposed between the channel and ceiling. Sauer et al. also discloses means for joining two wall structures including an elongated channel member having a web anchored to a panel member of one wall structure and a sound seal interposed between the channel web and the panel member to deaden sound transmission. In addition, U.S. Pat. No. 3,324,615 to Zinn discloses a resiliently mounted acoustical wall partition.

It is also known to provide a wall assembly having cushion members attached to resiliently arranged tabs connecting wall boards to studs. For example, U.S. Pat. No. 3,611,653 to Zinn discloses a sound attenuation wall partition having wall boards secured to a fixed flange forming a part of the stud, the wall boards yieldably bearing against the support tabs forming a part of an intermediate stud providing yieldable mountings for the wall boards. In addition, U.S. Pat. No. 3,972,167 to Vögeli discloses wall panels connected to supports through cushioning material.

Other complex wall structures have also been proposed for minimizing the transmission of sound through the wall. What is needed is a wall assembly having a simple structure that can minimize the transmission of sound through the wall while maximizing the structural strength of the wall. Manufacturers and builders alike will appreciate such an assembly that can be easily and cost effectively produced and constructed.

According to the present invention, a wall assembly and unique sound deadening components such as studs for constructing the assembly are provided. The wall assembly includes a first wall half having a first frame and a first wall panel connected to the first frame. A second wall half having a second frame and a second wall panel connected to the second frame is positioned to lie adjacent to the first frame so that the first wall panel is generally parallel to the second wall panel. Resilient material is sandwiched between the first frame and the second frame.

In preferred embodiments, the wall extends between a floor and a ceiling. The wall includes an elongated first floor angle mounted to the floor and an elongated second floor angle mounted to the floor, the second floor angle being parallel to and spaced-apart from the first floor angle. An elongated first ceiling angle is mounted to the ceiling and is positioned to lie above the first floor angle. An elongated second ceiling angle is mounted to the ceiling, the second ceiling angle being parallel to and spaced-apart from the first ceiling angle. The second ceiling angle is positioned to lie above the second floor angle. Resilient vibration-absorbing material is sandwiched between each of the ceiling angles and the ceiling. Resilient vibration-absorbing material is also sandwiched between each of the floor angles and the floor.

The wall further includes an elongated first pair of side wall angles mounted to a first side wall that is abutted by the wall in accordance with the present invention. The first pair of side wall angles includes a first side wall angle mounted to the first side wall and extending vertically between a first end of the first ceiling angle and a first end of the first floor angle. The first pair of side wall angles also includes a second elongated side wall angle spaced-apart from the first side wall angle and mounted to the first end of the second ceiling angle and a first end of the second floor angle. Resilient vibration-absorbing material is sandwiched between each of the side wall angles and the first side wall. If the wall additionally abuts a second side wall opposing the first side wall, the new wall further includes a third and fourth side wall angles mounted similarly to the first and second side wall angles having resilient vibration-absorbing material sandwiched between each of the third and fourth side wall angles and the second side wall.

An elongated vertically extending stud is spaced apart from both pairs of side wall angles. The stud extends between the floor angles and the ceiling angles. The stud includes an elongated first stud channel extending generally vertically between the first floor angle and the first ceiling angle. An elongated second stud channel extends generally vertically between the second floor angle and the second ceiling angle. Resilient vibration-absorbing material is sandwiched between the first and second stud channels.

Additional studs having a construction similar to the first stud may be included in the wall. The additional studs are spaced apart from the pairs of side wall channels and from the first stud by an amount dictated by the length of the wall and specifications established for each construction project using methods well known by those skilled in the art. Dry wall is then attached to the angles and both sides of the studs to complete the wall.

Thus, the wall assembly in accordance with the present invention includes a first half forming one side of the wall and a second half forming an opposing side of the wall. Each wall half includes a wall panel and a frame preferably having a ceiling angle, a floor angle, and a side angle adjacent to each abutted side wall, the wall panel being attached to the frame. The frame of each half of the wall is vibration isolated from the floor, the ceiling, the abutted side wall, and the other wall half by resilient vibration-absorbing material.

The resilient vibration-absorbing material inhibits the transmission of sound between the first half and the second half of the wall. In addition, the resilient vibration-absorbing material resists the transfer of thermal energy to thermally isolate the first and second wall halves.

As described above, the wall assembly preferably includes a stud positioned to lie between two wall panels. The stud includes a generally vertically extending first stud portion and a generally vertically extending second stud portion. Resilient vibration-absorbing material is sandwiched between the first and second stud portions.

In preferred embodiments, the first and, second stud portions are made from metal. The resilient vibration-absorbing material is preferably an adhesive holding the first and second stud portions together. The resilient vibration-absorbing material is preferably also an insulator resisting the transfer of thermal energy. Thus, in addition to reducing the transmission of sound, the stud in accordance with the present invention provides increased structural strength and improved thermal insulating capability. The stud in accordance with the present invention thus provides several characteristics including vibration transfer and thermal energy transfer normally associated with wooden studs while also providing the precision associated with steel studs and steel building materials.

The vibration-absorbing studs are preferably made from two elongated C-shaped sections that are connected by a vibration-absorbing material. The C-shaped sections are joined to form an S-shaped section with the vibration-absorbing material sandwiched therebetween. In preferred embodiments, the vibration-absorbing material is additionally an adhesive so that the same layer of material can both hold the two C-shaped sections together as well as absorb vibrations once the wall is erected.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
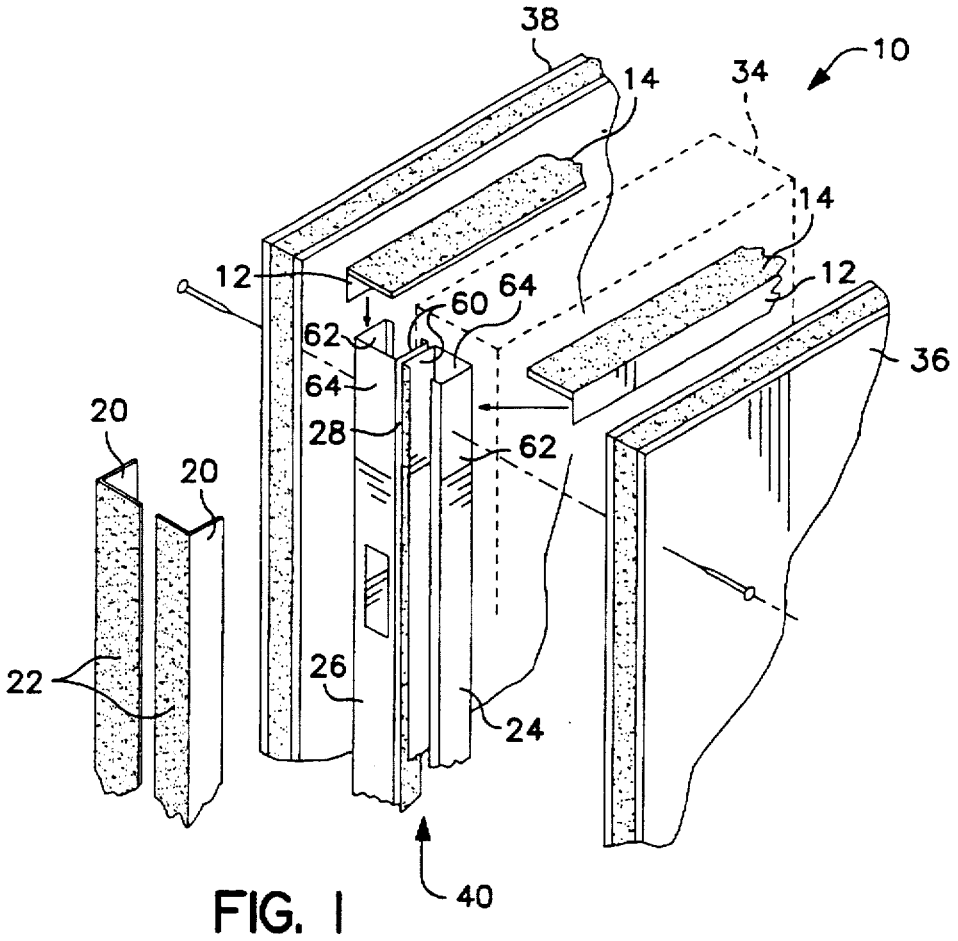
FIG. 1 is an exploded perspective view of a wall assembly in accordance with the present invention showing a sound attenuation blanket or insulation (in phantom), two elongated ceiling angles positioned above the insulation and having a coating of resilient vibration-absorbing material thereon, two vertical side wall abutting angles having a coating of resilient vibration-absorbing material thereon, a metal stud having two elongated stud portions connected by a layer of resilient vibration-absorbing material sandwiched therebetween, and two opposing wall panels connected to the stud, the ceiling angles, and the side wall angles, the sound attenuation blanket or insulation being sandwiched between the wall panels.

A wall assembly 10 for minimizing the transmission of sound and thermal energy through wall assembly 10 is shown in FIGS. 1–4. Wall assembly 10 includes spaced-apart parallel first and second ceiling angles 12 attached to ceiling 32 as shown in FIG. 1. A resilient vibration-absorbing material 14 is sandwiched between ceiling 32 and ceiling angles 12. In preferred embodiments, resilient material 14 is also an adhesive material. Resilient material 14 thus serves to dampen the transmission of vibrations between ceiling angles 12 and ceiling 30 as well as to adhere ceiling angles 12 to ceiling 30. Although resilient material 14 operates to adhere ceiling angles 12 to ceiling 30, ceiling angles 12 can also be bolted or in some other manner attached to ceiling 30 without exceeding the scope of the invention as presently perceived so long as vibration is dampened to minimize the transmission of sound between ceiling 30 and ceiling angles 12.

Figure 2:
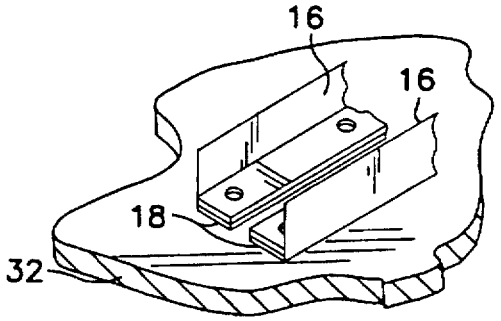
FIG. 2 is a perspective view of first and second elongated spaced-apart floor angles of the wall of FIG. 1 connected to the floor and positioned to lie below the ceiling angles (not shown)

Wall assembly 10 also includes spaced-apart parallel first and second floor angles 16 attached to floor 32 as shown in FIG. 2. Elongated floor angles 16 are preferably positioned to lie directly beneath elongated ceiling angles 12. A resilient vibration-absorbing material 18 is sandwiched between floor angles 16 and floor 32. In preferred embodiments, resilient material 18 is also an adhesive material. Thus, resilient material 18 operates to both minimize the transmission of vibrations between floor 32 and floor angles 16 and to adhere floor angles 16 to floor 32. Although resilient material 18 operates to adhere floor angles 16 to floor 32, floor angles 16 can also be bolted or in some other manner attached to floor 32 as shown in FIG. 2 without exceeding the scope of the invention as presently perceived so long as vibration is dampened to minimize the transmission of sound between floor 32 and floor angles 16.

Typically, wall assembly 10 is constructed to extend between and abut both a first side wall (not shown) and a second side wall (not shown) so that wall assembly 10 includes two pairs of side wall angles 20. In such circumstances, a pair of side wall angles 20 is mounted to each side wall. In addition, each side wall angle 20 is connected to one of ceiling angles 12 as shown in FIG. 1, and extends vertically downwardly therefrom to one of floor angles 16. Each side wall angle 20 is connected to one of the ceiling angles 12 and one of the floor angles 16 so that first and second side wall angles 20 are parallel and spaced-apart, and so that side wall angles 20 extend vertically between ceiling angles 12 and floor angles 16.

Additionally, one pair of side wall angles 20 is attached to first side wall (not shown) and the second pair of side wall angles 20 is attached to the second side wall (not shown). Resilient vibration-absorbing material 22 is sandwiched between each side wall angle 20 of the first pair of side wall angles 20 and the first side wall. Resilient material 22 is also sandwiched between each side wall angle 20 of the second pair of side wall angles 20 and the second side wall. Preferably, resilient material 22 is also an adhesive. Thus, resilient material 22 operates to dampen the transmission of vibration between the first side wall and each angle 20 of the first pair of side wall angles 20 as well as dampening vibration between the second side wall and each angle 20 of the second pair of side wall angles 20. In addition, resilient material 22 operates to adhere each pair of side wall angles 20 to each respective first and second side wall. Although resilient material 22 operates to adhere the side wall angles 20 to each of the first and second side walls, side wall angles 20 can additionally be bolted or by some other manner attached to each of the first and second side walls without exceeding the scope of the invention as presently perceived so long as vibration is dampened to minimize the transmission of sound between side wall angles 20 and the sidewalls.

A plurality of vertically-extending metal studs are positioned to lie between and are spaced-apart from the pairs of side wall angles 20. The horizontal spacing between the vertical studs is typically 16 inches (40.6 cm), however the spacing can be varied to meet the needs of the specific construction project without exceeding the scope of the invention as presently perceived. The number of studs 40 included in wall assembly 10 will depend upon the distance between the first side wall (not shown) and the second side wall (not shown) and the desired spacing between studs 40.

Figure 3:
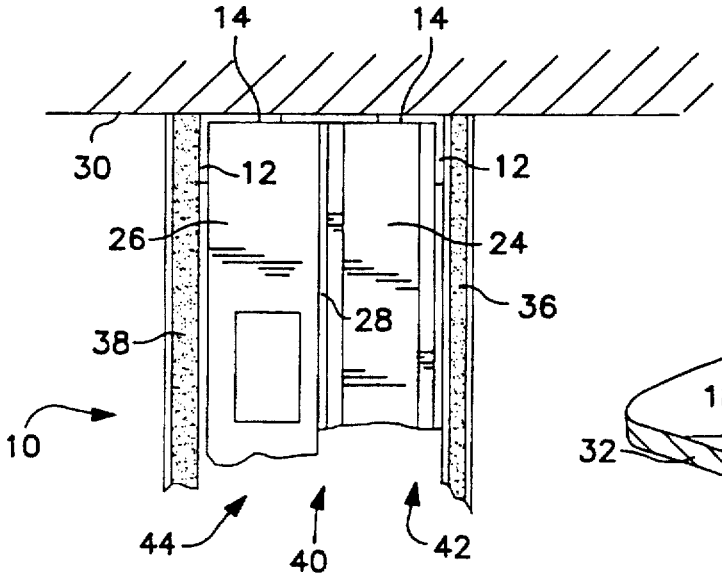
FIG. 3 is an end elevation view of the wall of FIG. 1 showing the ceiling angles connected to the ceiling with resilient material sandwiched therebetween, a stud in accordance with the present invention connected to the ceiling angles, the stud including first and second elongated stud channels with resilient material sandwiched therebetween, and two wall panels connected to the stud and the ceiling angles.
Figure 4:
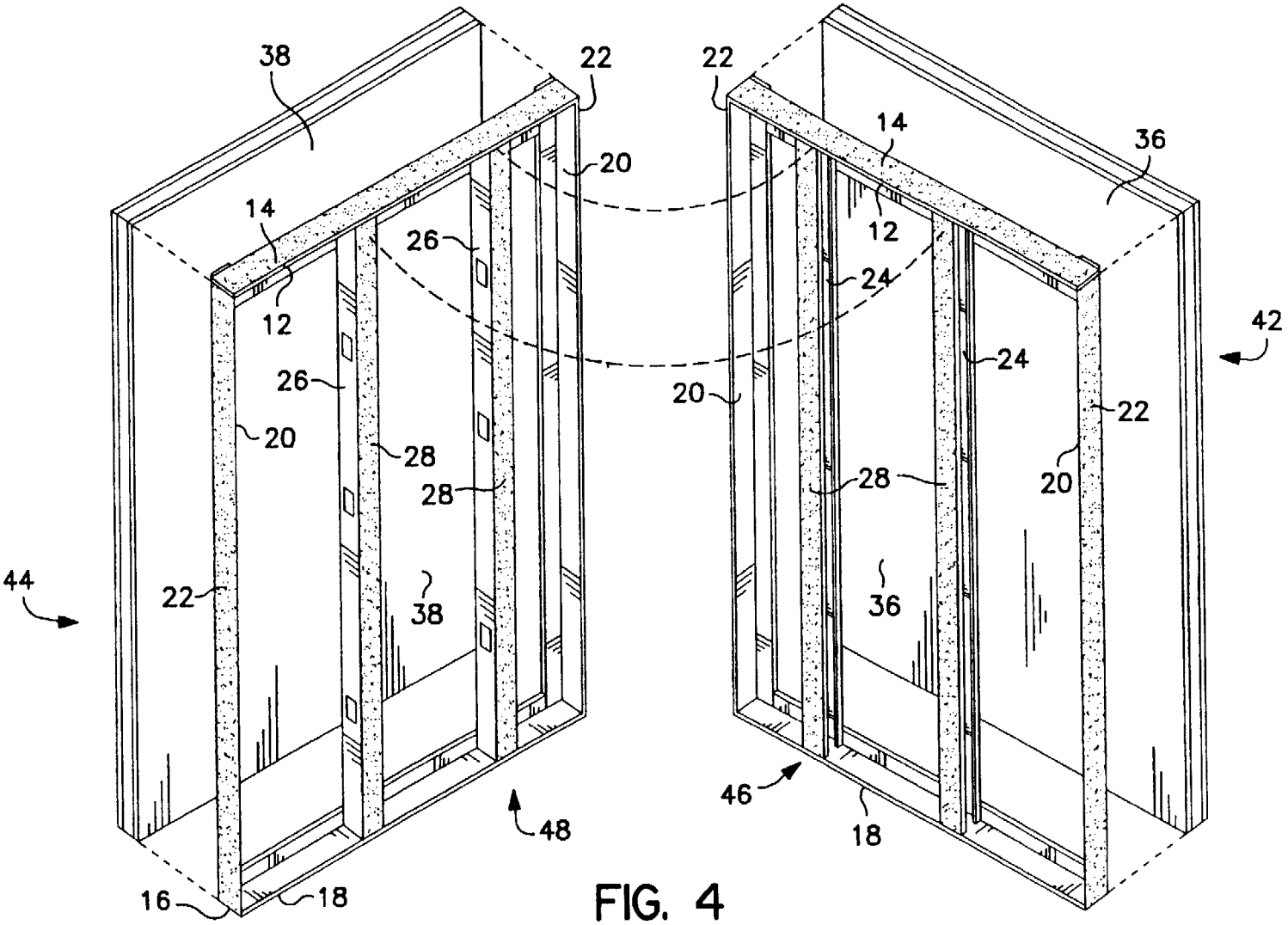
FIG. 4 is an exploded perspective view of the wall assembly of FIG. 3 showing two wall frames joined by resilient vibration absorbing material, each wall frame carrying a wall panel.

Each stud 40 includes a vertically extending first stud portion or channel 24 and a vertically extending second stud portion or channel 26 as shown in FIGS. 1, 3, and 4. The first and second stud channels 24, 26 are parallel and spaced-apart. A resilient vibration-absorbing material 28 is sandwiched between the first and second stud channels 24, 26. First and second stud channels 24, 26 each include an elongated first flange 60, an elongated second flange 62 spaced apart from first flange 60, and a web 64 connecting first and second flanges 60, 62. In preferred embodiments, first flange 60 of first stud channel 24 engages resilient material 28 and first flange 60 of second stud channel 26 engages resilient material 28 so that first stud channel 24 cooperates with resilient material 28 and second stud channel 26 to provide stud 40 with an S-shaped cross section as shown best in FIG. 1.

It will be understood by those skilled in the art that although channel 24 cooperates with resilient material 28 and channel 26 to define stud 40, channels 24, 26 and resilient material 28 can define various elongated structural members. For example, channels 24, 26 and resilient material 28 can define beams, joints, rafters and other elongated structural members without exceeding the scope of the invention as presently perceived.

Preferably, resilient material 28 is also an adhesive. Thus, resilient material 28 operates to both dampen the transmission of vibration between the first and second stud channels 24, 26 as well as to adhere first stud channel 24 to second stud channel 26. In the presently preferred and illustrative embodiment of studs 40, first and second stud channels 24, 26 are adhered together solely by resilient material 28. However, first and second stud channels 24, 26 can be bolted together, clamped together, or attached by any other suitable means without exceeding the scope of the invention as presently perceived so long as vibration is dampened to minimize the transmission of sound between stud channel 24 and stud channel 26. In the wall assembly, of course, each stud channel 24, 26 is connected to one of the ceiling angles 12 and to one of the floor angles 16.

Resilient vibration-absorbing material 14, 18, 22, 28 is preferably a rubber compound such as 2068 Lightweight High Performance Sealer (the 2068 Sealer), also known as PTI vinyl coating, manufactured by H. B. Fuller and Co., although any suitable vibration-absorbing material can be used without exceeding the scope of the invention as presently perceived. It has been found that the 2068 Sealer provides suitable vibration-absorbing characteristics when applied having a thickness greater than 0.020 inches (greater than 0.05 cm). The presently preferred thickness is between 1/16 and 1/8 inches (0.15 and 0.32 cm).

A first wall panel 36 can be connected to first stud channel 24, first ceiling angle 12, and first floor angle 16 as shown in FIG. 4. A second wall panel 38 can be connected to second stud channel 26, second ceiling angle 12, and second floor angle 16 so that second wall panel 38 opposes and is generally parallel to first wall panel 36. In addition, first and second wall panels 36, 38 may also be attached to first and second side wall angles 20, respectively, if first or second wall panels 36, 38 abut one of the first and second side walls (not shown). First and second wall panels 36, 38 constructed in this manner form opposing sides of wall assembly 10. A sound attenuation blanket or insulation 34 may be received in the space defined between first and second wall panels 36, 38 if desired.

Wall assembly 10 thus provides a wall having two vibration isolated wall halves 42, 44 as shown in FIG. 4. First wall half 42 includes first wall panel 36 and a first frame 46 and second wall half 44 includes second wall panel 38 and a second frame 48. The first and second wall panels are connected to first and second frames 46, 48, respectively, and each frame 46, 48 is connected to each of ceiling 30, floor 32, side walls (not shown), and one another through layers of resilient vibration-absorbing material 14, 18, 22, 28.

As can be seen for first wall half 42, each connection between first wall half 42 and each engaged surface is buffered by a layer of resilient vibration-absorbing material 14, 18, 22, 28. For example, first wall panel 36 is connected to ceiling angle 12 which is attached to ceiling 30 through resilient material 14. Also, first wall panel 36 is connected to floor angle 16 which is attached to floor 32 through resilient material 18. In addition, if first wall panel 36 abuts one of the first and second side walls (not shown), then first wall panel 36 is attached to side wall angle 20 which is fixed to one of the first and second side walls through resilient material 22. Finally, first wall panel 36 is connected to second wall panel 38 through first stud channel 24 which is connected to second stud channel 26 through resilient material 28. In the same manner, second wall half 44 is connected to each engaged surface through resilient vibration-absorbing material 14, 18, 22, 28.

By having all connections between wall panels 36, 38 and each engaged surface surrounding wall panels 36, 38 including opposing wall panels 36, 38 made through resilient vibration-absorbing material 14, 18, 22, 28, each half 42, 44 of wall assembly 10 is vibration isolated, minimizing the transmission of sound through wall assembly 10. This system differs from known prior art systems which provide wall panels connected directly through studs of unitary construction that directly connecting the first and second wall panels. In addition, known prior art configurations typically have floor channels and ceiling channels of unitary construction that directly connect the first and second wall panels. Also, known prior art systems typically have side wall channels of unitary construction directly connecting the first and second wall panels for abutting connections between walls. Thus, while known prior art walls provide solid, vibration transmitting connections between both sides of the prior art walls and the surrounding structure, wall assembly 10 provides only vibration isolated connections therebetween.

Figure 5:
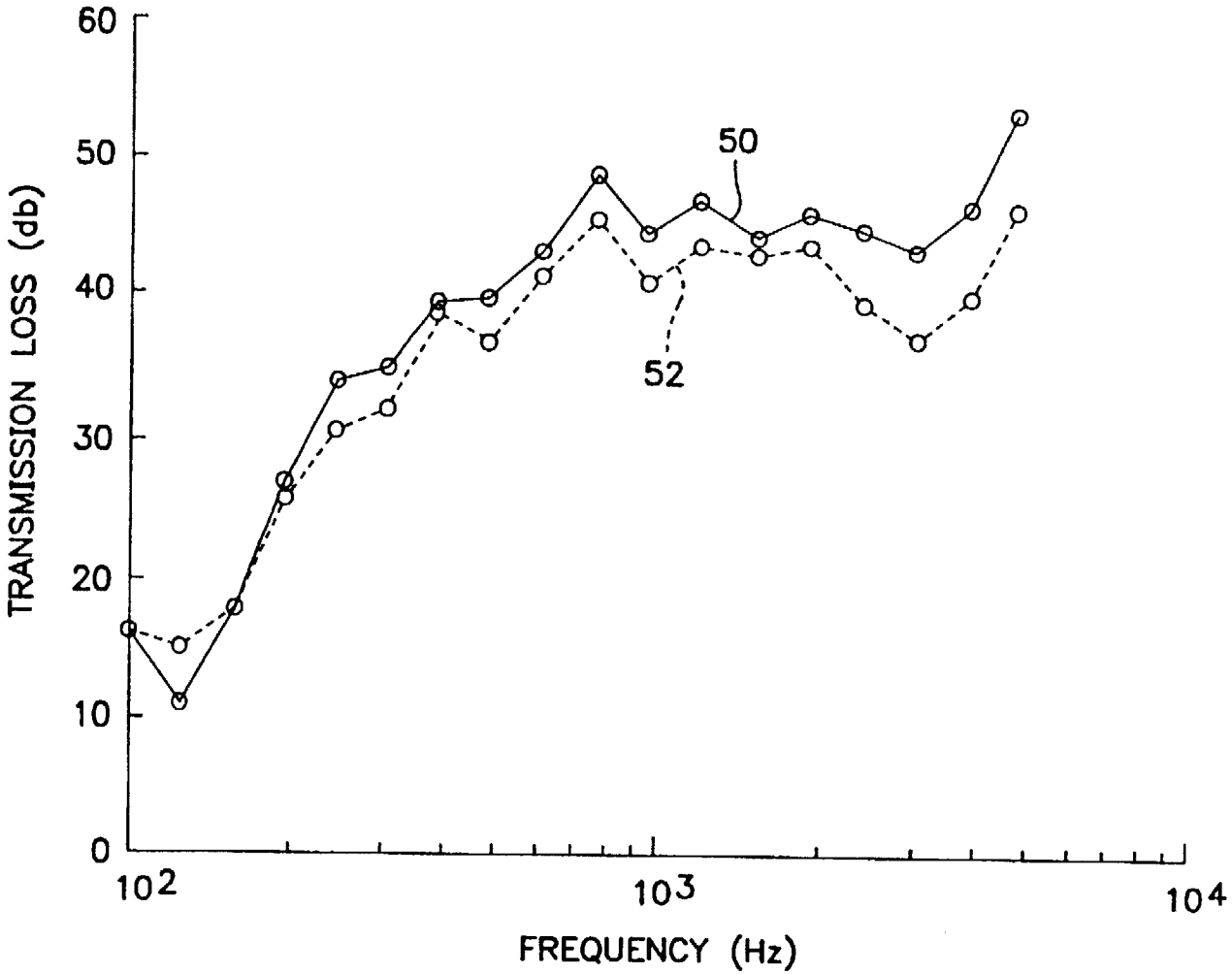
FIG. 5 is a chart graphically representing acoustic test data of the transmission loss through a standard steel-stud wall and the transmission loss of the wall assembly in accordance with the present invention showing improved transmission loss through the wall assembly in accordance with the present invention.

Acoustic tests were preformed comparing the transmission loss through wall assembly 10 to the transmission loss through a standard steel-stud wall ("the standard wall"). The acoustic tests were conducted at the Herrick Laboratories at Purdue University under the auspices of the Purdue University Technical Assistance Program. The transmission loss of wall 10 and the standard wall are graphically represented in FIG. 5 showing the transmission loss in decibels through wall 10 at various frequencies as a solid line 50 and showing the transmission loss in decibels through the standard wall as a dashed line 52.

The transmission loss of each wall was measured at several frequencies between 100 Hz and 10,000 Hz. As can be seen, the transmission loss of wall 10 is several decibels higher than that of the standard wall in the mid-frequency range (around 1,000 Hz). Thus, the experimental wall should be more effective at speech isolation than the standard wall since the speech range is approximately 500 Hz to 2,000 Hz. At low frequencies, the transmission loss performance of wall 10 and the standard wall are essentially the same.

Figure 6:
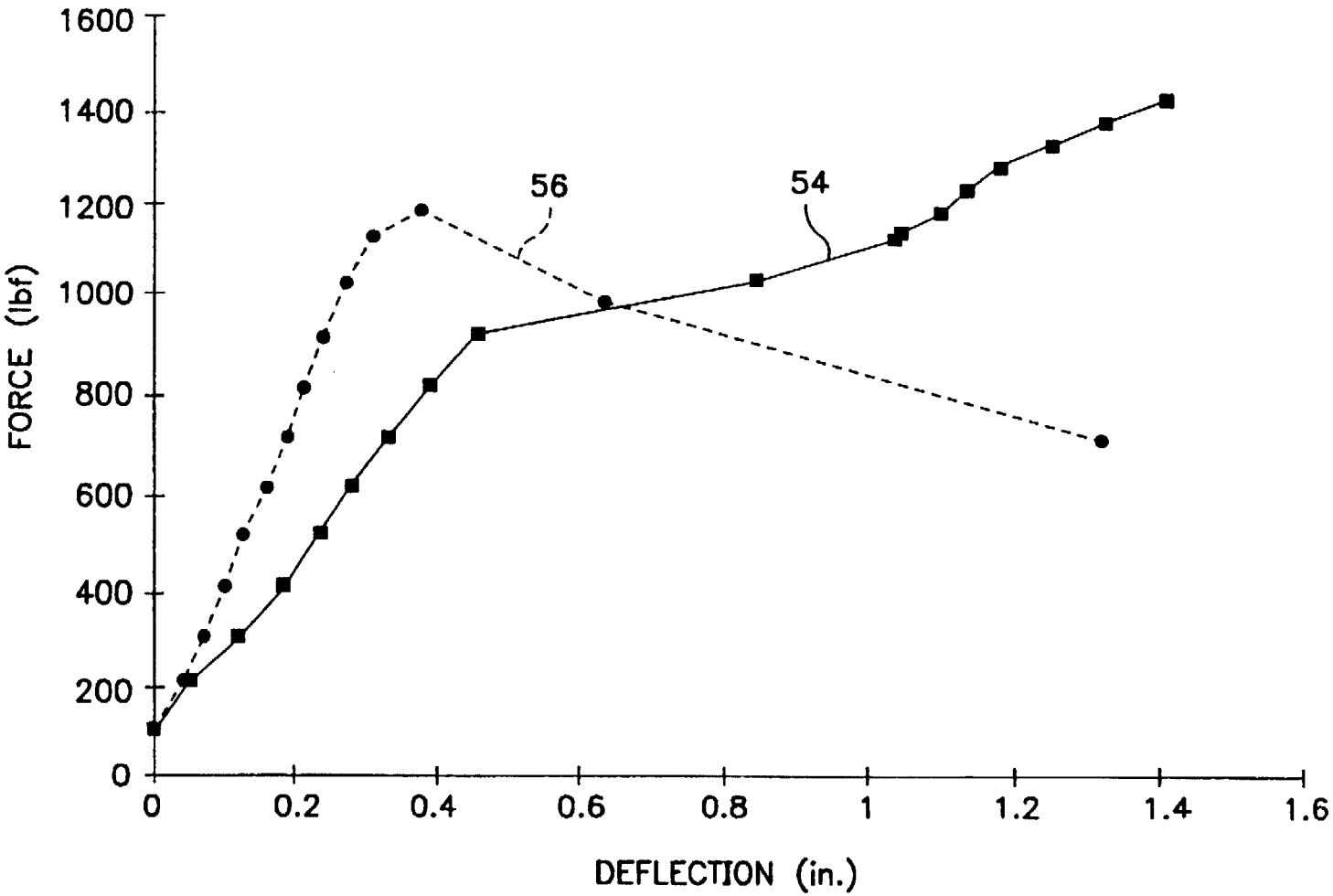
FIG. 6 is a chart graphically representing strength test data of a standard steel-stud wall and the wall assembly in accordance with the present invention showing that the wall assembly in accordance with the present invention can carry more transverse load that the standard wall but is not as stiff as the standard wall under moderate loading.

Strength tests comparing the deflection of wall 10 having various loads applied thereto to the deflection of the standard wall having various loads applied thereto were also conducted at the Herrick Laboratories at Purdue University under the auspices of the Purdue University Technical Assistance Program. The strength of wall 10 and the standard wall are graphically represented in FIG. 6 showing the deflection (in inches) of wall 10 having force applied to wall 10 (in pounds-force) as a solid line 54 and showing the deflection (in inches) of the standard wall having force applied to the standard wall (in pounds-force) as a dashed line 56.

The strength testing was conducted using a large press, a load cell, and dial gauges. Two lower I-beams supported the wall and the load was applied to an upper I-beam resting on the wall. The wall section was 36.35 inches (92.1 cm) wide and the unsupported span was 33.25 inches (84.5 cm) wide. The load cell, positioned between the upper I-beam and the press, measured the load applied by the press. The weights of the upper I-beam and the load cell were accounted for when calculating the actual load on the wall. Two dial gauges were used to measure the deflection of the wall. Force was applied at the center of the unsupported span and the deflection was measured at the center of the unsupported span.

The load was applied gradually to each wall in 100 pound-force increments. Deflection was measured at each step. As shown in FIG. 6, wall 10 is less stiff than the standard wall at most of the loads considered. However, wall 10 sustained a greater load than did the standard wall and the standard wall failed when subjected to loads that wall 10 was able to support without such failure.

It has also been found that in addition to reducing the sound transmission through wall assembly 10 and increasing the strength of wall assembly 10, resilient vibration-absorbing material 14, 18, 22, 28 can reduce thermal transmission between wall halves 42, 44. Thus, wall assembly 10 minimizes the transmission of both vibration or sound and thermal energy from room to room.

Finally, it has been found that using a resilient vibration-absorbing material of the type described herein inhibits the galvanic corrosion of the portions of wall assembly 10 to which the resilient vibration-absorbing material is applied. Thus, wall assembly 10 minimizes the weakening of the wall by minimizing the galvanic corrosion of portions of wall assembly 10 that are coated by the resilient vibration-absorbing material.

Although the invention has been described in detail with reference to a preferred embodiment, variations and modifications exist within the scope and spirit of the invention as described and defined in the following claims.

We claim:

1. A wall assembly comprising a first wall half including a first frame and a first wall panel connected to the first frame, a second wall half including a second frame and a second wall panel connected to the second frame, the second frame being positioned to lie adjacent to the first frame so that the first wall panel is generally parallel to the second wall panel, and wherein said first frame and said second frames abut each other with a resilient attachment material sandwiched between the first frame and the second frame to secure the first and second frame to each other.

2. The wall assembly of claim 1, wherein the resilient material is an adhesive and the resilient material adheres the first frame to the second frame.

3. The wall assembly of claim 1, wherein the resilient material is a thermal insulator so that thermal transmission between the first frame and the second frame is minimized.

4. The wall assembly of claim 1, wherein the first frame includes a C-shaped channel, the second frame includes a C-shaped channel, and the C-shaped channel of the first frame is positioned to lie adjacent to the C-shaped channel of the second frame with resilient material sandwiched therebetween, and the C-shaped channel of the first frame cooperates with the C-shaped channel of the second frame and with the resilient material to define a stud of the wall.

5. The wall assembly of claim 4, wherein the first frame and the second frame are both formed to include a plurality of C-shaped channels, the C-shaped channels of the first frame cooperating with the C-shaped channels of the second frame and with resilient material to define a plurality of studs of the wall.

6. The wall assembly of claim 1, wherein the first frame includes a ceiling angle, a floor angle, and a generally vertically-extending C-shaped channel extending between the ceiling angle and the floor angle.

7. The wall assembly of claim 6, wherein the second frame includes a ceiling angle, a floor angle, and a generally vertically-extending C-shaped channel extending between the ceiling angle and the floor angle of the first and second frames.

8. The wall assembly of claim 7, wherein the C-shaped channel of the first frame is positioned to lie adjacent to the C-shaped channel of the second frame and the resilient material is positioned to lie therebetween.

9. The wall assembly of claim 6, wherein the ceiling angle has a generally upwardly-facing top surface, the floor angle has a generally downwardly-facing bottom surface, the C-shaped channel has a generally inwardly-facing side surface, and resilient material is positioned to lie on each of the top surface, the bottom surface, and the side surface so that the first wall half is vibration isolated.

10. The wall assembly of claim 9, wherein the second frame includes a ceiling angle, a floor angle, and a generally vertically-extending C-shaped channel extending between the ceiling channel and the floor channel and the ceiling channel has a generally upwardly-facing top surface, the floor angle has a generally downwardly-facing bottom surface, the C-shaped channel has a generally inwardly-facing side surface, and resilient material is positioned to lie on each of the top surface, the bottom surface, and the side surface so that the second wall half is vibration isolated.

11. A wall assembly comprising a first wall panel, a second wall panel spaced apart from the first wall panel and extending generally parallel thereto, and a first stud portion connected to the first wall panel, a second stud portion positioned adjacent to and abutting the first stud portion and connected to the second wall panel, and means for securing the two stud portions together and for absorbing vibration, the securing vibration-absorbing means being positioned to lie between the first stud portion and the second stud portion.

12. The wall assembly of claim 11, wherein the vibration absorbing means includes means for resisting conduction of thermal energy.

13. The wall assembly of claim 11, wherein the wall assembly extends generally vertically between a ceiling and a floor, the first panel includes a top edge adjacent to the ceiling and a bottom edge adjacent to the floor, the second panel includes a top edge adjacent to the ceiling and a bottom edge adjacent to the floor, and further comprising a first ceiling angle connected to the first panel adjacent to the top edge of the first panel, a second ceiling angle connected to the second panel adjacent to the top edge of the second panel, and second means for absorbing vibration, the second vibration-absorbing means being positioned to lie between each of the first and second ceiling angles and the ceiling.

14. The wall assembly of claim 13, further comprising a first floor angle connected to the first panel adjacent to the bottom edge of the first panel, a second floor angle connected to the second panel adjacent to the bottom edge of the second panel, and third means for absorbing vibration, the third vibration-absorbing means being positioned to lie between each of the first and second floor angles and the floor.

15. The wall assembly of claim 11, wherein the wall assembly abuts a side wall, the first panel includes a side edge adjacent to the side wall, the second panel includes a side edge adjacent to the side wall, and further comprising a first side wall angle connected to the first panel adjacent to the side edge of the first panel, a second side wall angle connected to the second panel adjacent to the side edge of the second panel, and second means for absorbing vibration, the second vibration-absorbing means being positioned to lie between each of the first and second side wall angles and the side wall.

16. A stud for attachment to two wall panels of a wall assembly comprising an elongated first C-shaped stud portion for attachment to a first wall panel, an elongated second C-shaped stud portion for attachment to a second wall panel spaced apart from the first stud portion and extending generally parallel thereto, wherein each C-shaped channel has an elongated first flange, an elongated second flange, and an elongated web connecting the first and second flanges, the first flange of the first stud portion and the first flange of the second stud portion abutting each other, and resilient attachment material between the two flanges so that the first stud portion is attached to the second stud portion to provide the stud with an S-shaped cross section.

17. The stud of claim 16, wherein the resilient material is an adhesive and the second stud portion is adhered to the first stud portion by the resilient material.

18. The stud of claim 16, wherein the resilient material is a thermal insulator so that thermal transmission between the first frame and the second frame is minimized.

19. An elongated structural member for supporting two panel members comprising an elongated C-shaped cross-sectioned first portion for attachment to a first panel member and having a first end portion, an elongated C-shaped cross-sectioned second portion for attachment to a second panel member and having an end portion in abutting relation to the end portion of the first portion and extending generally parallel to the first portion to create a structural member with a generally S-shaped cross-section a resilient attachment material sandwiched between the two end portions to provide a joined composite member having vibration and sound deadening features provided by the resilient attachment material.

* * * * *